US007325474B2

(12) United States Patent
Yoshimura et al.

(10) Patent No.: US 7,325,474 B2
(45) Date of Patent: Feb. 5, 2008

(54) SILENCER

(75) Inventors: Shoji Yoshimura, Takasago (JP); Yasumasa Kimura, Kobe (JP); Zenzo Yamaguchi, Kobe (JP)

(73) Assignee: Kabushiki Kaisha Kobe Seiko Sho, Kobe-shi (JP)

( * ) Notice: Subject to any disclaimer, the term of this patent is extended or adjusted under 35 U.S.C. 154(b) by 190 days.

(21) Appl. No.: 11/000,033

(22) Filed: Dec. 1, 2004

(65) Prior Publication Data

US 2005/0126382 A1 Jun. 16, 2005

(30) Foreign Application Priority Data

Dec. 15, 2003 (JP) ..... 2003-416641

(51) Int. Cl.
*F41A 21/30* (2006.01)

(52) U.S. Cl. ..... 89/14.4; 181/232; 181/252; 181/223; 181/277; 181/258

(58) Field of Classification Search ..... 188/222, 188/223, 277, 256, 257, 258; 89/14.4; 181/232, 181/252, 222, 223, 277, 256, 257, 258
See application file for complete search history.

(56) References Cited

U.S. PATENT DOCUMENTS 723,111 A * 3/1903 Winton ..... 181/236
825,010 A * 7/1906 Snow ..... 181/264
3,842,932 A * 10/1974 Gibel ..... 181/258
3,892,536 A * 7/1975 Roeser et al. ..... 422/169
4,751,980 A * 6/1988 DeVane ..... 181/239
5,145,026 A * 9/1992 Wilder ..... 181/233

FOREIGN PATENT DOCUMENTS

JP 62-93418 * 4/1987
JP 3275527 2/2002

* cited by examiner

*Primary Examiner*—Stephen M. Johnson
(74) *Attorney, Agent, or Firm*—Oblon, Spivak, McClelland, Maier & Neustadt, P.C.

(57) ABSTRACT

The present invention relates to a silencer easily cleanable inside. This silencer comprises a casing cylinder and a segment member housed in the casing cylinder to constitute a sound reducing means. The silencer further comprises a segment member fastening means for fastening the segment member to the casing cylinder, a gas inlet-side lid plate with a punched hole, which closes an opening at one end of the casing cylinder, and a gas outlet-side lid plate with a punched hole, which closes an opening at the other end of the casing cylinder. At least either one of the gas inlet-side lid plate or the gas outlet-side lid plate is adapted to be detachable from the casing cylinder.

3 Claims, 7 Drawing Sheets

SILENCER

BACKGROUND OF THE INVENTION

1. Field of the Invention

The present invention relates to improvements in silencers and, more specifically, to a silencer used for a compressor for compressing contaminated gas including impurities such as tar or dust.

2. Description of the Related Art

In compressors of middle size or more, a silencer is mounted in the middle of a gas discharge pipe in order to reduce noise of compressed gas to be discharged. Silencers fall into two types and, concretely, sound extension type and sound absorption type, which are differentiated in sound reducing performance as described below. A sound extension type silencer is unfavorable in the sound reducing performance regarding to noise out of a sound reducing frequency range because its reducing frequency range is determined, while a sound absorption type silencer is excellent in the sound absorbing performance regarding to a wide range of frequencies. However, the sound extension type silencer is generally used more, for example, in an oil-cooled screw compressor for discharging oil-containing gas in spite of its inferior sound reducing performance to the sound absorption type silencer, since the sound absorbing performance of the sound absorption type silencer is significantly reduced when liquid is absorbed into a sound absorbing material. However, a sound absorption type silencer adapted to be usable in such an oil-cooled screw compressor for discharging oil-containing gas is also known.

For example, a silencer shown in FIGS. 12 and 13 is disclosed in Japanese Patent No. 3275527. FIG. 12 is a sectional view of a sound absorption type silencer according to the related art, and FIG. 13 is a perspective view of the same.

As shown in FIGS. 12 and 13, a muffler 50 according to the related art comprises a cylindrical case 45 having bottoms 44 with openings 43 at both ends, and a sound muffling material 51 which consists of a soft porous synthetic resin and is provided on the inside of the case where an air flow passage 46 communicating with the openings 43 is arranged in the center. A plurality of the sound muffling materials 51 are laminated in the axial direction, and skewered with axial bars 53 through holes 52 on the outside of the air passage 46 so as to prevent the deformation of the air flow passage 46 caused by the dynamic pressure of the gas treated. The bars 53 are fixed to a retaining plate 54 having an outer shape contacting with an inner wall of the case 45 while having the air flow passage 46 in the center part.

In case of a COG (coke oven gas) compressor, which compresses coke oven gas containing tar or dust, the coke oven gas containing tar and dust is passed through an inner part of the sound absorption type silencer. The tar or dust (hereinafter referred to as impurities) contained in the coke oven gas is adhered to the sound absorbing material or the inner part to deteriorate a sound absorbing effect of the sound absorption type silencer. As a matter of course, in case of the sound extension type silencer, the impurities are also accumulated in the inner part to deteriorate the sound absorbing effect.

Accordingly, in order to continue a desired sound absorbing effect, either type of silencers needs periodic cleaning of the inner part to remove the deposits.

However, the silencer according to the conventional example has an integrated structure, which disables cleaning from the outside, as is understood well from the above description for its structure. Therefore, if cleaning is unavoidably required, the silencer is cut off and restored by welding after cleaning to reuse, or generally replaced by a new silencer, and thus has a problem such as an extremely troublesome work and increasing cost in maintenance of the silencer.

SUMMARY OF THE INVENTION

The present invention thus has an object to solve the above-mentioned problem with the maintenance and to provide a silencer easily cleanable inside.

The silencer of the present invention comprises a casing cylinder; a segment member housed in the casing cylinder to constitute a sound reducing means; a segment member fastening means for fastening the segment member to the casing cylinder; a gas inlet-side lid plate for closing an opening at one end of the casing cylinder, the gas inlet-side lid plate having a punched hole; and a gas outlet-side lid plate for closing an opening at the other end of the casing cylinder, the gas outlet-side lid plate having a punched hole, wherein at least one of the gas inlet-side lid plate and the gas outlet-side lid plate is adapted to be detachable from the casing cylinder.

The silencer of the above structure is preferably adapted so that a plurality of segment members are laminated and housed in the casing cylinder; and that the segment member fastening means comprises a tie rod member to be drawably inserted through the segment members, the tie rod member integrally fastening the segment members.

In the silencer having the above structure, preferably, the segment member comprises a segment cylinder and a punched plate having a punched hole concentric with the segment cylinder; and a peripheral part of the punched plate is continued to an end of the segment cylinder.

The segment member with the punched plate can be adapted so as to comprise two punched plates with peripheral parts of the two punched plates being respectively continued to both ends of the segment cylinder, and a sound absorbing material filled in a space enclosed by the segment cylinder and the two punched plates. The segment member can further comprise an inner cylinder consisting of a perforated plate formed in a cylindrical shape smaller in size than the segment cylinder, with both ends of the inner cylinder being continued to the punched holes of the two punched plates. The segment member with the punched plate otherwise can be adapted so that one punched plate is disposed so that a peripheral part of the punched plate is continued to one end of the segment cylinder. Further, the segment cylinder can be adapted to comprise a perforated plate formed in a cylindrical shape with an outer diameter which leaves a clearance with an inner wall of the casing cylinder when integrated into the casing cylinder.

According to the silencer of the present invention, at least one of the gas inlet-side lid plate and the gas outlet-side lid plate is removed from the casing cylinder and the segment member fastening means is removed, whereby the segment member can be taken out of the casing. After cleaning the taken segment member and the inner part of the casing, the segment member is integrated into the casing, the segment member fastening means is mounted, and the removed gas inlet-side lid plate or gas outlet-side lid plate is mounted on the casing cylinder, whereby the silencer can be restored to the original state. As a matter of course, the segment member can be replaced by a new segment member.

DETAILED DESCRIPTION OF THE PREFERRED EMBODIMENT

Figure 1:
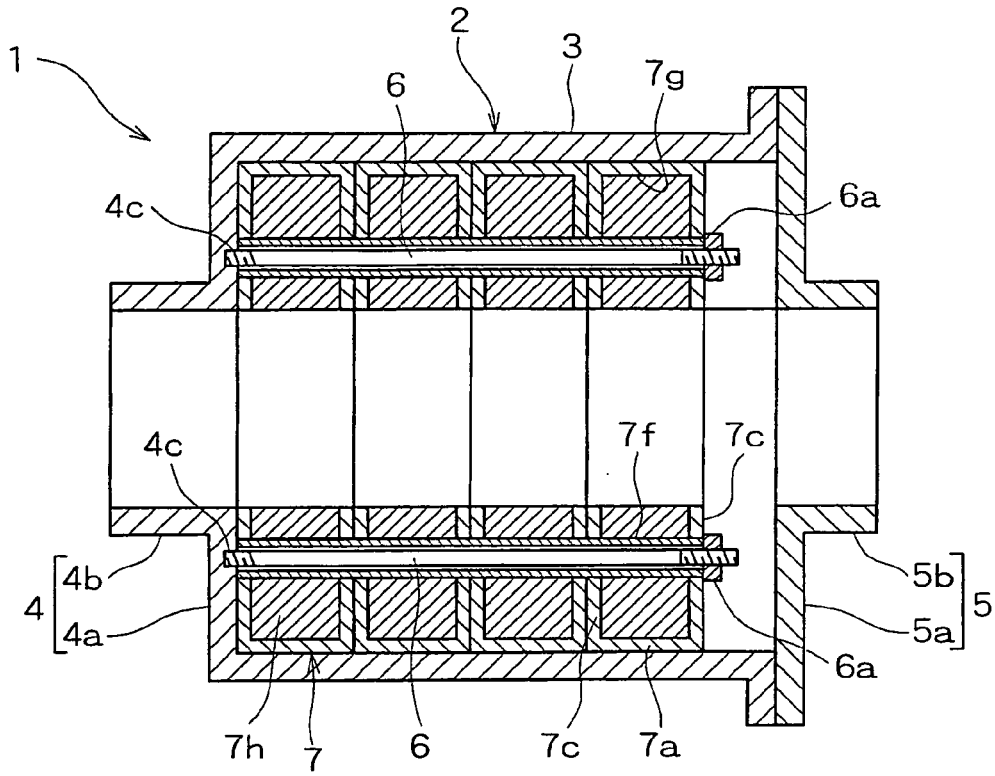
FIG. 1 is a side sectional view of a silencer according to a first preferred embodiment of the present invention.
Figure 2:
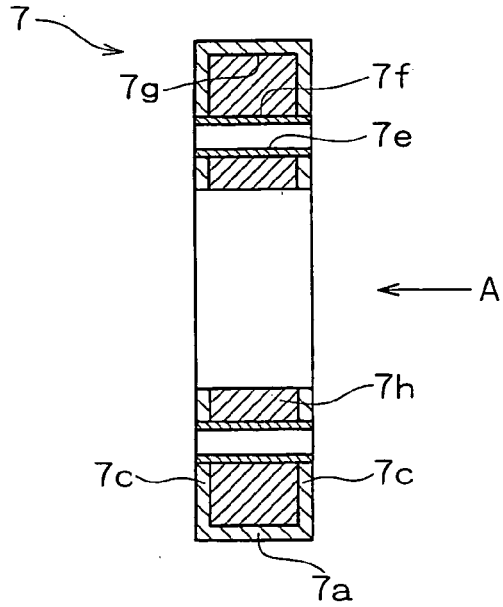
FIG. 2 is a side sectional view of an annular segment member of the silencer according to the first embodiment of the present invention.
Figure 3:
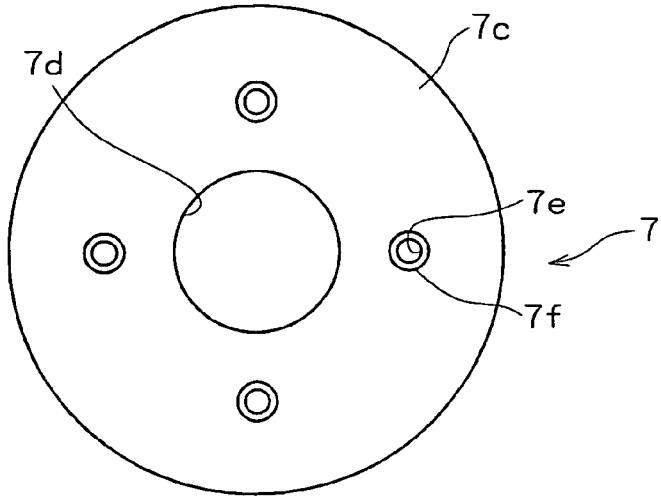
FIG. 3 is an A-directional view of FIG. 2.

A silencer according to a first embodiment for execution of the present invention will be described with reference to the accompanying drawings. FIG. 1 is a side sectional view of a silencer according to a first preferred embodiment of the present invention; FIG. 2 is a side sectional view of an annular segment member of the silencer according to the first embodiment of the present invention; and FIG. 3 is an A-directional view of FIG. 2.

Denoted at 1 in FIG. 1 is a silencer and the silencer 1 comprises a casing 2 having a structure described later. The casing 2 comprises a cylindrical casing cylinder 3, a gas inlet-side lid plate 4 for closing one end of the cylindrical casing cylinder 3, and a gas outlet-side lid plate 5 for closing the other end thereof. The gas inlet-side lid plate 4 comprises a lid member 4*a* for closing one end of the casing cylinder 4 and a tubular gas inlet 4*b* protrusively provided in the radial center of the lid member 4*a*. The lid member 4*a* and the gas inlet 4*b* are formed in an integrated form with the casing cylinder 3. The gas outlet-side lid plate 5 comprises a lid member 5*a* detachably mounted on the other end of the cylinder 3 by a mechanical fastening means (not shown) such as a bolt or a stud and a nut to close the opening of the casing cylinder 3, and a tubular gas outlet 5*b* protrusively provided in the radial center of the lid member 5*a*. The lid member 5*a*. and the gas outlet 5*b* are formed in an integrated form.

In the first embodiment of the present invention, the gas outlet-side lid plate 5 is adapted to be detachably mounted on the casing cylinder 3 by the mechanical fastening means such as a bolt or a stud and a nut as described above. The gas inlet-side lid plate 4 may be adapted to be detachably mounted on the casing cylinder 3 by the mechanical fastening means such as a bolt or a stud and a nut instead. It is a rod mounting screw 4*c* for screwing a tie rod member described later that is provided on the surface opposed to the gas outlet-side lid plate 5 of the lid member 4*a* of the gas inlet-side lid plate 4. The rod mounting screw 4*c* is provided in four positions on a circle around the radial center of the lid member 4*a* at equal intervals, although not shown in the drawing.

One end side of the tie rod member 6 externally threaded (not shown) at both ends is screwed to each of the four rod mounting screws 4*c* provided on the lid member 4*a* of the gas inlet-side lid plate 4. Annular segment members 7, which are a plurality of segment members constituting a structure described later, are integrated to the rod mounting screws 4*c* through-holes in a laminated state, and fastened in the state where they are housed in the casing 2 by nuts (fastening means) 6*a* to the respective other end sides of the tie rod members 6. In the first embodiment, four annular segment members 7 are housed in the casing 2 as described above. The number of the segment members may be three, or five or more without being limited to four. The number of the tie rod members 6 may also be three, five or more without being limited to four.

The annular segment member 7 comprises a segment cylinder 7*a* formed by bending a flat plate in a cylindrical shape, and two punched circular plates 7*c* with peripheral parts being continued to both ends of the segment cylinder 7*a*. Each of the two punched plates 7*c* has four through-holes 7*e* for inserting the tie rod members 6 through rod inserting pipes 7*f*, and punched holes 7*d* concentric with the segment cylinder 7*a* in the radial center part. A sound absorbing material 7*h* comprising stainless wool is filled in an annular space 7*g* enclosed by the segment cylinder 7*a* and the two punched circular plates 7*c*. By the above structure, the annular segment member 7 is constituted as a sound reducing means. The silencer 1 having the annular segment members 7 as sound reducing means integrated thereto thus can obtain an excellent silencing effect.

A working mode of the silencer 1 having the above structure will be then described. According to the silencer 1 of the present invention, the gas outlet-side lid plate 5 is removed from the casing cylinder 3, and the nuts 6*a* are removed from the tie rod members 6, whereby a plurality of annular segment members 7 integrated in a laminated form can be independently taken out of the casing 2. After the inner part of the casing 2 is cleaned, new annular segment members 7 are integrated to the casing 2, and fastened by screwing the nuts 6*a* to the external threads at the tips of the tie rod members 6, and the taken gas outlet-side lid plate 5 is mounted on the casing cylinder 3, whereby the silencer 1 can be restored to the original usable state. Namely, in the silencer 1 of the present invention, when cleaning is required, there is no need for cutting the silencer and restoring by welding after cleaning, different from the silencer of an integrated structure according to the conventional example. It is only the annular segment members 7 that are to be replaced by new ones. According to the silencer 1 of the present invention, thus, an effect that maintenance works become more advantageous than the conventional example can be provided.

In Japanese Patent No. 3275527 described above, it is mentioned that the silencer disclosed therein can be easily attached to the cylindrical case, but no specific structure for facilitating a series of works such as removal or mounting from and to the casing 2 (cylindrical case) unlike the present invention. According to the silencer 1 of the present invention, the removal or mounting of the plurality of annular segment members 7 from and to the casing 2 can be facilitated.

The soft sound absorbing material 7*h* is not barely integrated into the casing 2, but filled in the annular space 7*g* enclosed by the segment cylinder 7*a* and the two punched circular plates 7*c*. Namely, the soft sound absorbing material is filled in a hard structure. Accordingly, there is no possibility that the sound absorbing material is too deformed to be reused in removing from or mounting on the casing 2, and it can be easily treated.

Figure 4:
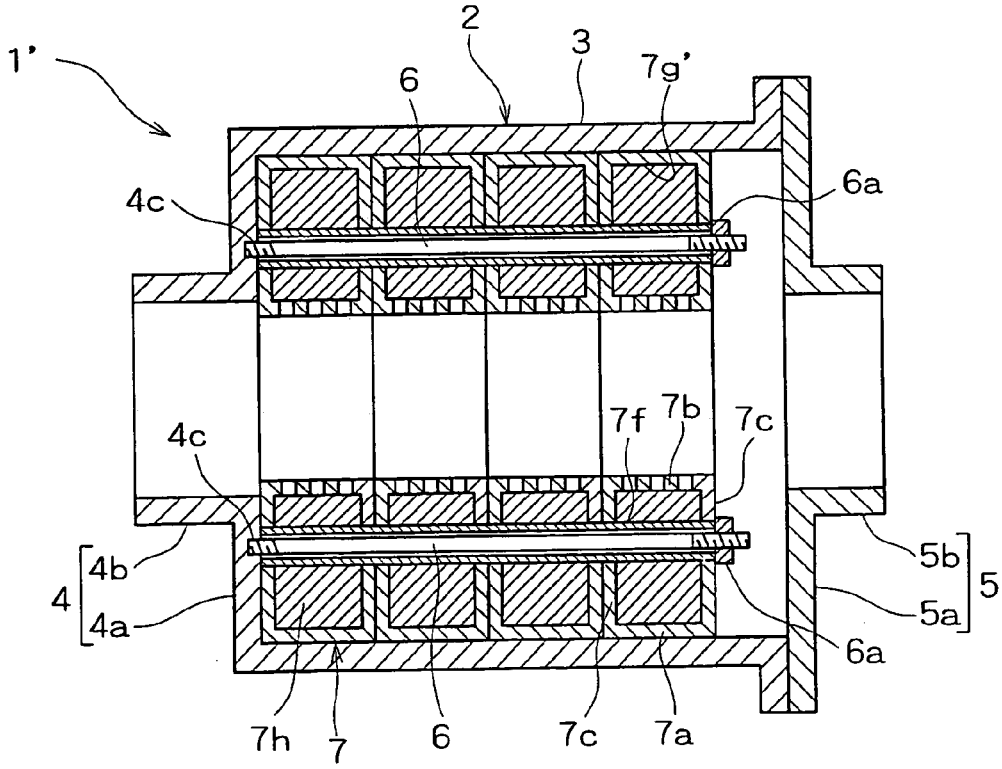
FIG. 4 is a side sectional view of a silencer according to a second embodiment of the present invention.
Figure 5:
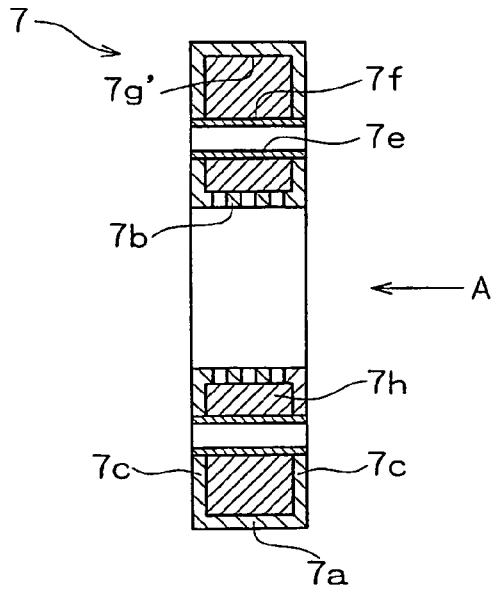
FIG. 5 is a side sectional view of an annular segment member of the silencer according to the second embodiment of the present invention.

A silencer according to the second embodiment of the present invention will be then described with reference to the accompanying drawings. FIG. 4 is a side sectional view of the silencer according to the second embodiment of the present invention, and FIG. 5 is a side sectional view of an annular segment member of the same silencer. Since the difference between the second embodiment and the first embodiment lies in the structure of the annular segment member, this difference will be mainly described while assigning the same reference numbers to the same members.

An annular segment member 7' comprises, in addition to the structure of the silencer according to the first embodiment of the present invention shown in FIGS. 1 to 3, an inner cylinder 7*b* consisting of a perforated plate formed in a cylindrical shape smaller in size than the segment cylinder 7*a* with both ends being continued to the punched holes 7*d* of two punched plates 7*c*. By this structure, an annular space 7*g'* formed by the two punched plates 7*c* of the annular segment member 7' and the inner cylinder 7*b* can be a closed space not communicating with the outside except pores provided in the inner cylinder 7*b*. Therefore, there is no need for a treatment such that, after filled in the annular space 7*g'*, the sound absorbing material 7*h* comprising stainless wool is formed into a shape close to the annular space 7*g'* in order to prevent the deformation of the sound absorbing material 7*h*. An effect for maintenance is equal to the effect of the silencer according to the first embodiment.

Figure 6:
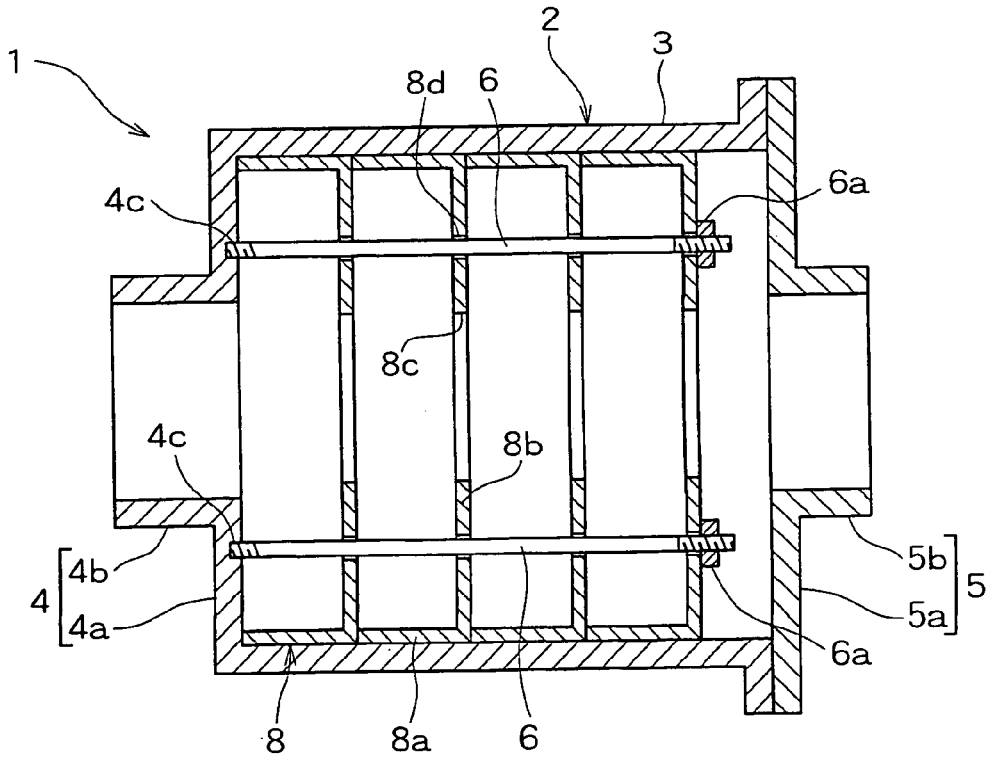
FIG. 6 is a side sectional view of a silencer according to a third embodiment of the present invention.
Figure 7:
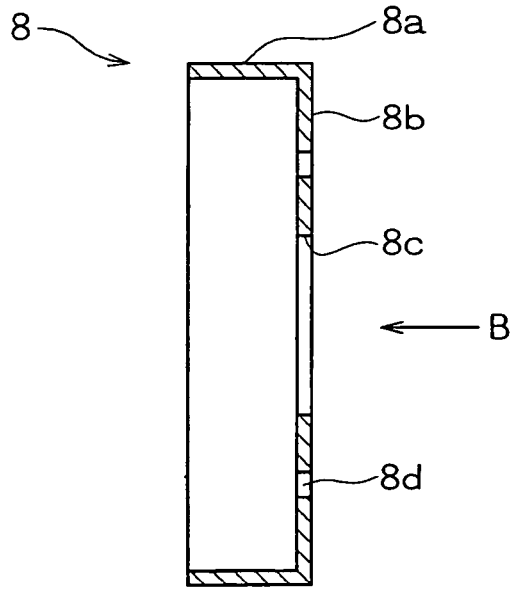
FIG. 7 is a side sectional view of an annular segment member of the silencer according to the third embodiment of the present invention.
Figure 8:
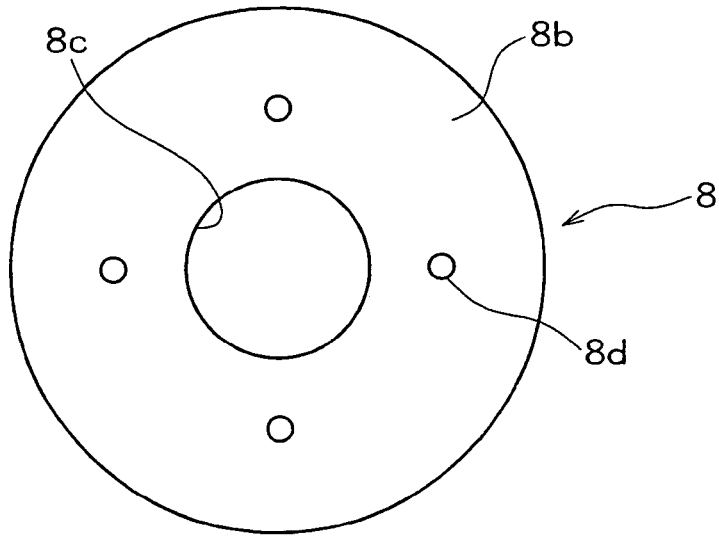
FIG. 8 is a B-directional view of FIG. 7.

A silencer according to the third embodiment of the present invention will be described with reference to the accompanying drawings. FIG. 6 is a side sectional view of the silencer according to the third embodiment; FIG. 7 is a side sectional view of an annular segment member of the same silencer; and FIG. 8 is a B-directional view of FIG. 7. Since the difference between the third embodiment and the first embodiment lies in the structure of the annular segment member, this difference will be mainly described while assigning the same reference numbers to the same members.

Namely, an annular segment member 8 comprises a segment cylinder 8*a* formed by bending a flat plate in a cylindrical shape and a punched circular plate 8*b* with peripheral part being continued to one end of the segment cylinder 8*a*, a punched hole 8*c* concentric with the segment cylinder 8*a* and a through-hole 8*d* for inserting through a tie rod member 6. As is understood well from the above description, the silencer 1 according to the third embodiment is a sound extension type silencer. The individual annular segment member 8 constitutes a sound reducing means by itself to realize the excellent silencing effect of the silencer 1 that is the sound extension type silencer. The sound extension type silencer means a silencer by the known method of obtaining a sound reducing effect by causing reflection of pressure pulsations of gas in a part where a section for passing the gas is changed when gas molecules are distributed. The size of each segment may be determined depending on the sound reducing frequency range. It can be determined by use of a known relational equation.

According to the silencer 1 of the third embodiment, similarly to the silencer of the first embodiment, the gas outlet-side lid plate 5 is removed from the casing cylinder 3, and the nuts 6*a* are removed from the tie rod members 6, whereby a plurality of annular segment members 8 integrated in a laminated state can be independently taken out of the casing 2. After cleaning the taken annular segment members 8 and the inside of the casing 2, the washed annular segment members 8 are integrated into the casing 2, and fastened by screwing the nuts 6*a* to the male threads at the tips of the tie rod members 6. The removed gas outlet-side lid plate 5 is then attached to the casing cylinder 3, whereby the silencer 1 can be restored to the original state. Therefore, the silencer 1 of the third embodiment has the equal effect to the silencer of the first embodiment.

Figure 9:
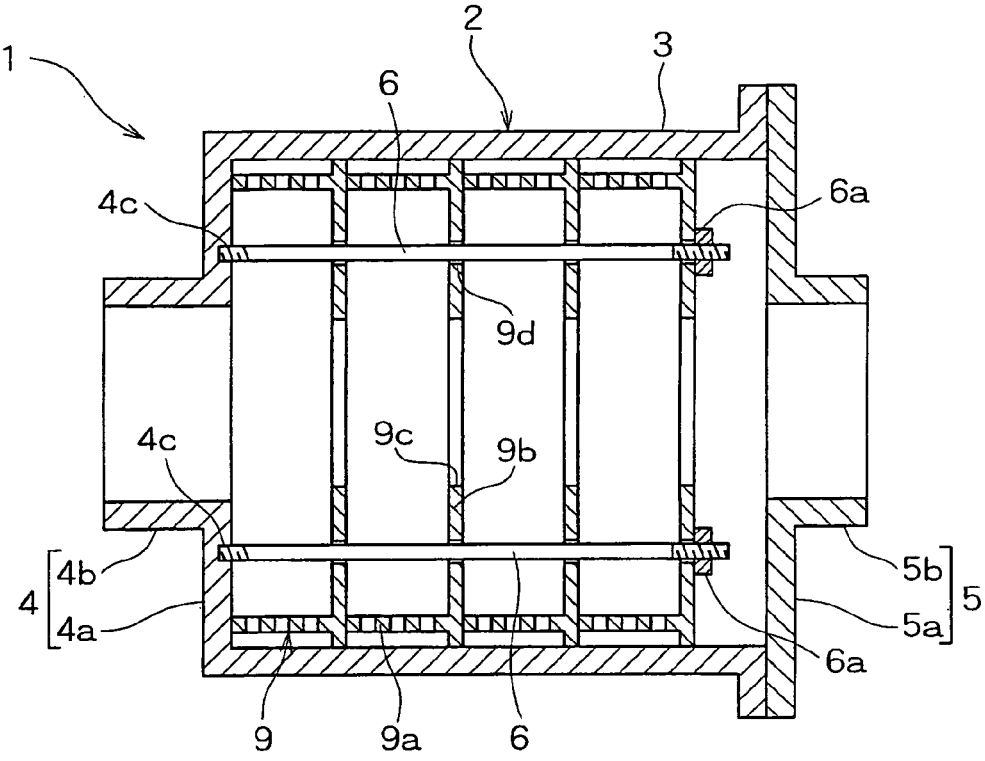
FIG. 9 is a side sectional view of a silencer according to a fourth embodiment of the present invention.
Figure 10:
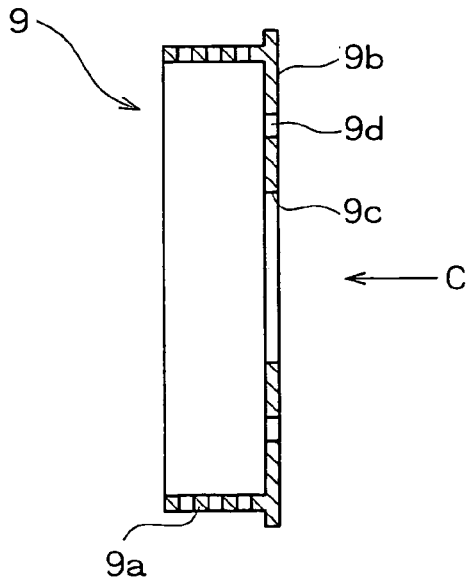
FIG. 10 is a side sectional view of an annular segment member of the silencer according to the fourth embodiment of the present invention.
Figure 11:
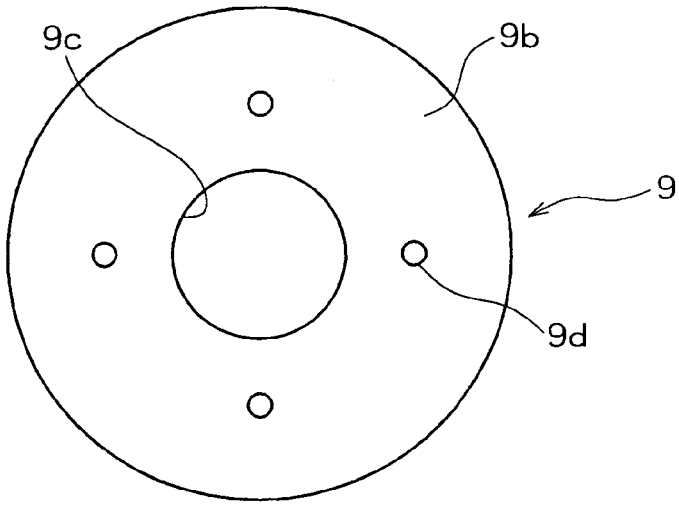
FIG. 11 is a C-directional view of FIG. 10.
Figure 12:
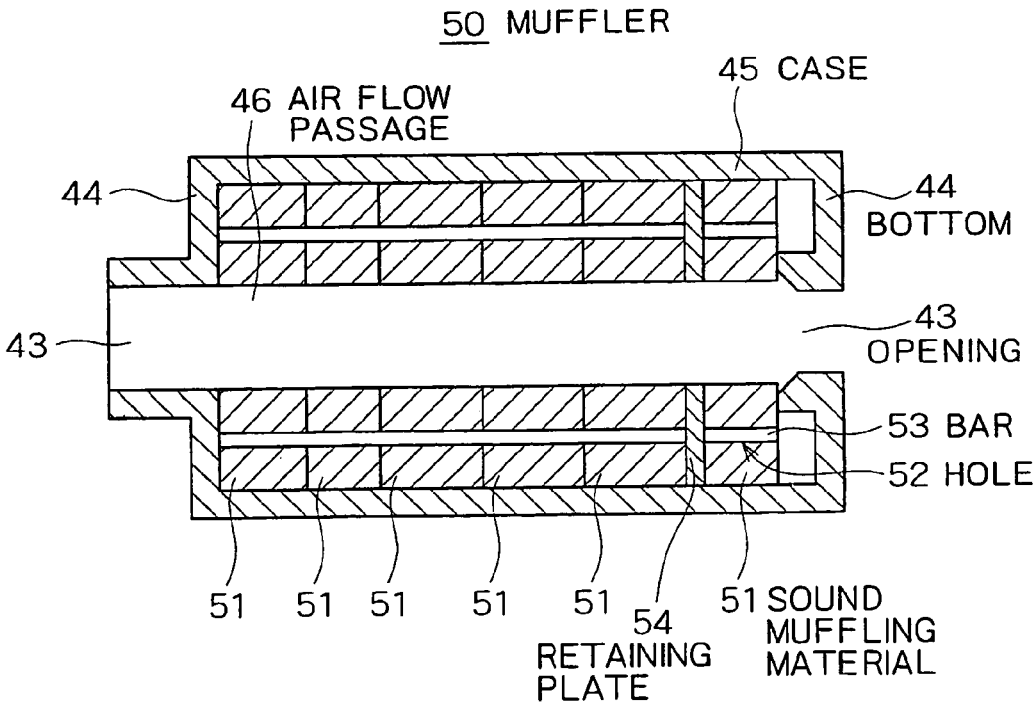
FIG. 12 is a sectional view of a sound absorbing type silencer according a prior art.
Figure 13:
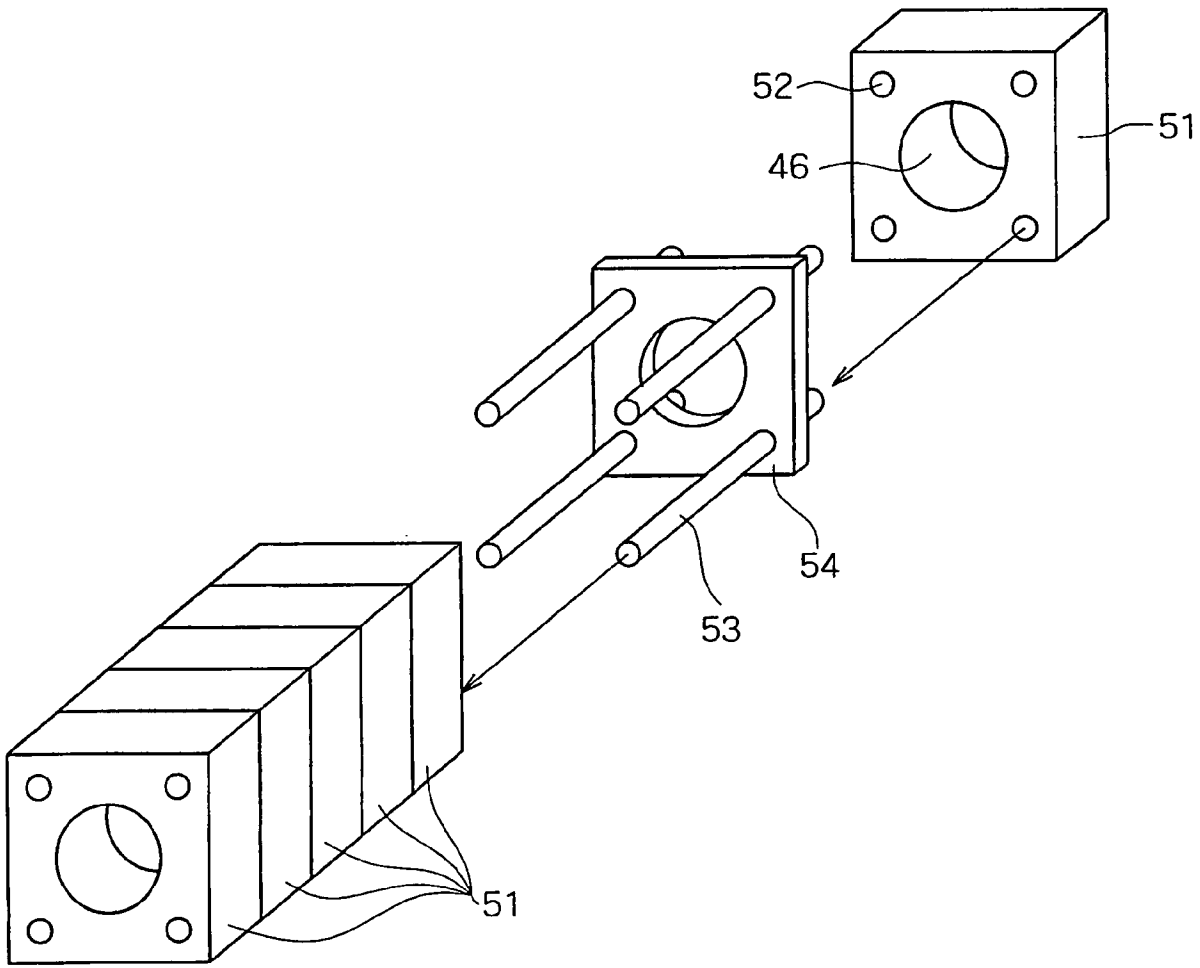
FIG. 13 is a perspective view of the sound absorbing type silencer according to the prior art.

A silencer according to the fourth embodiment of the present invention will be described with reference to the accompanying drawings. FIG. 9 is a side sectional view of the silencer of the fourth embodiment, FIG. 10 is a side sectional view of an annular segment member of the same silencer, and FIG. 11 is a C-directional view of FIG. 10. Since the difference between the fourth embodiment and the first embodiment lies in the structure of the segment member, similarly to the cases of the second and third embodiments, this difference will be mainly described while assigning the same reference numbers to the same members.

Namely, an annular segment member 9 comprises a segment cylinder 9*a* consisting of a perforated plate formed into a cylindrical shape by bending so as to have an outer diameter of the segment cylinder which leaves a clearance with the inner wall of the casing 2, and a punched circular plate 9*b* that is a punched plate connected to one end of the segment cylinder 9*a* and having a punched hole 9*c* concentric with the segment cylinder 9*a* and a through-hole 9*d* for inserting through the tie rod member 6. As is understood well from the above description, the silencer 1 of the fourth embodiment is a sound extension type silencer similarly to the silencer of the third embodiment. However, since the segment cylinder 9*a* consisting of the perforated plate is adopted in the annular segment member 9, this silencer can provide a silencing effect more excellent than the silencer of the third embodiment.

According to the silencer 1 of the fourth embodiment, similarly to the silencer of the first embodiment, the gas outlet-side lid plate 5 is removed from the casing cylinder 3, and the nut 6*a* is removed from the tie rod member 6, whereby the plurality of annular segment members 9 integrated in the laminated form can be independently taken out. After cleaning the removed annular segment members 9 and the inside of the casing 2, the cleaned annular segment members 9 are integrated into the casing 2, and fastened by screwing the nut 6*a* to the male threads at the tips of the tie rod member 6. The taken gas outlet-side lid plate 5 is attached to the casing cylinder 3, whereby the silencer 1 can be restored to the original state. Therefore, the silencer 1 of the fourth embodiment has the equal effect to the silencer of the first embodiment. In the annular segment member 9 of the fourth embodiment, as described above, the segment cylinder 9*a* consisting of the perforated plate of the annular segment member 9 is formed so as to have an outer diameter which leaves a clearance with the inner wall of the casing 2 when integrated into the casing 2. Accordingly, it has a sound reducing effect in passing gas through the segment cylinder 9*a*, and also has an effect of facilitating the integration and removal of the annular segment members 9.

In the first to fourth embodiments of the present invention, all of the casing cylinder, the segment cylinder and the inside cylinder are formed in circular shapes as examples, but each cylinder is not limited to the circularly cylindrical shape. For example, a sectional shape of each cylinder and a peripheral shape of each punched plate may be set to rectangular shapes.

The shape or size of each segment to be housed in one casing cylinder needs not to be uniform but different segments in terms of shape or size may be included. Further, a sound absorption type segment and a sound extension type segment may be simultaneously included in one casing cylinder.

The invention claimed is:

1. A silencer comprising:

a casing cylinder;

a plurality of abutting segment members laminated and housed in said casing cylinder to constitute a sound reducing means, wherein each of said segment members comprises a segment cylinder and at least two segment plates forming a hard structure, wherein said segment plates are punched plates having a punched hole concentric with the cylinder axis of the respective segment cylinder, and a peripheral part of each said punched plate is continued to an end of the respective segment cylinder, and sound absorbing material that is softer than the hard structure provided within the hard structure;

a segment member fastening means for fastening said segment member to said casing cylinder;

a gas inlet-side lid plate for closing an opening at one end of said casing cylinder, said gas inlet-side lid plate having a punched hole; and a gas outlet-side lid plate for closing an opening at the other end of said casing cylinder, wherein at least one of said gas inlet-side lid plate and said gas outlet-side lid plate is adapted to be detachable from said casing cylinder.

2. The silencer according to claim 1, wherein said segment member fastening means comprises a tie rod member to be drawably inserted through the plurality of said segment members, said tie rod member integrally fastening the plurality of said segment members.

3. The silencer according to claim 1, wherein said segment member further comprises an inner cylinder consisting of a perforated plate formed in a cylindrical shape smaller in size than said segment cylinder, with both ends of the inner cylinder being continued to the punched holes of said punched plates.

* * * * *